US006286949B1

(12) United States Patent
Lewis et al.

(10) Patent No.: US 6,286,949 B1
(45) Date of Patent: Sep. 11, 2001

(54) INK SUPPLY STATION WITH FLOATING INTERFACE COMPONENTS FOR INDEPENDENT COUPLING WITH MANUALLY REPLACEABLE INK MODULES

(75) Inventors: Richard H Lewis, Santa Maria De Palautordera Barcelona (ES); Curtis N. Torgerson, San Diego, CA (US); Xavier Gasso Puchal, Barcelona (ES); Rhonda L Wilson, East Monmouth; Eric L Gasvoda, Salem, both of OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/495,584

(22) Filed: Feb. 1, 2000

Related U.S. Application Data

(63) Continuation-in-part of application No. 08/871,566, filed on Jun. 4, 1997, now Pat. No. 6,074,042.

(51) Int. Cl.[7] ..... B41J 2/175

(52) U.S. Cl. ..... 347/86

(58) Field of Search ..... 347/84, 85, 86, 347/87, 7

(56) References Cited

U.S. PATENT DOCUMENTS 4,568,954 * 2/1986 Rosback ..... 347/86
5,917,526 * 6/1999 Wilson et al. ..... 347/86

* cited by examiner

*Primary Examiner*—N. Le
*Assistant Examiner*—Anh T. N. Vo

(57) ABSTRACT

A modular ink delivery system is incorporated in an inkjet printer to facilitate replacement of individual ink supply modules. A rigid interface component on the printer carries an electrical connector, an ink connector, and an air connector which match corresponding connectors on the ink supply module. A separate interface component for each ink supply module is spring-loaded on a printer frame in order to rest in either a forward parking position against a backplate or a rearward floating position that allows the interface component to move and rotate some distance in all directions to achieve proper alignment position when engaged by the ink supply module.

17 Claims, 12 Drawing Sheets

SECTION 6 - 6′

SECTION 7 - 7'

INK SUPPLY STATION WITH FLOATING INTERFACE COMPONENTS FOR INDEPENDENT COUPLING WITH MANUALLY REPLACEABLE INK MODULES

RELATED APPLICATIONS

The present application is a continuation-in-part of U.S. application Ser. No. 08/871,566 filed Jun. 4, 1997 now U.S. Pat. No. 6,074,042 by Eric L.Gasvoda, et al. entitled REPLACEABLE INK CONTAINER ADAPTED TO FORM RELIABLE FLUID, AIR AND ELECTRICAL CONNECTION TO A PRINTING SYSTEM, which is commonly owned by the assignee of the present application and is incorporated herein by reference.

This application is also related to U.S. application Ser. No. 09/240,039 filed Jan. 29, 1999 by Xavier Gasso, et al. entitled REPLACEABLE INK DELIVERY TUBE SYSTEM FOR LARGE FORMAT PRINTER, which is commonly owned by the assignee of the present application and is incorporated herein by reference.

BACKGROUND OF THE INVENTION

The present invention relates to ink-jet printing systems, and more particularly, ink-jet printing systems which make use of ink containers that are replaceable separate from a printhead.

Inkjet printers frequently make use of an inkjet printhead mounted to a carriage which is moved back and fourth across a print media, such as paper. As the printhead is moved across the print media, a control system activates the printhead to deposit ink droplets onto the print media to form images and text.

Previously used printers have made use of an ink container that is separably replaceable from the printhead. When the ink cartridge is exhausted the ink cartridge is removed and replaced with a new ink container. The use of replaceable ink containers that are separate from the printhead allow users to replace the ink container without replacing the printhead. The printhead is then replaced at or near the end of printhead life and not when the ink container is exhausted.

Previously used off-axis ink delivery systems have made use of a memory device located in the ink container for altering the printhead drive conditions based on the information stored in the memory device. For example, U.S. Pat. No. 5,506,611 to Ujita et al discloses the use of a memory device having electric terminals for providing drive conditions to the printhead. These drive conditions include drive voltage, pulse width, frequency, and the number of preliminary discharges. The memory device is mounted to the outer surface of the ink cartridge so that electrical contacts for the memory device are spaced apart on the outer surface of the ink cartridge. As the ink cartridge is inserted into the ink-jet printer, electric terminals associated with the bubble-jet printer contact the electric terminals associated with the ink cartridge.

It is important that the ink container and printer form proper electrical connection to ensure proper printer operation. Proper electrical connection requires that each electrical contact associated with the ink container be electrically connected to a corresponding electrical contact associated with the printer portion. In addition, each of these electrical connections should be a reliable low resistance electrical connection.

There is an ever present need for printing systems which are capable of providing low operating costs such as printers which make use of off-axis type ink supplies. In addition, these printing systems should be easy to operate, such as, including some form of memory for storing printing parameters so that the user is not required to adjust printer parameters when the ink container is replaced. These ink supplies should be capable of reliable insertion into the printing system to ensure proper fluid interconnection and proper electrical interconnection with the printer is achieved. In addition, these interconnections should be reliable and should not degrade over time and use. For example, the fluid interconnect should not leak during use or over time and the electrical interconnect should be reliable during use and over time. In addition, these ink cartridges should not require special handling by the user and should be reliable and easily connected by the user to form a positive highly reliable mechanical, electrical, and fluid interconnect with the printer.

These ink containment systems should be capable of providing ink at high flow rates to a printhead thereby allowing high throughput printing. This ink supply system should be cost effective to allow relatively low cost per page printing. In addition, the ink supply should be capable of providing ink at high flow rates in a reliable manner to the printhead.

Finally, electrical interconnection between the ink container and printer should be reliable without requiring relatively large contact force. The use of relatively large contact force tends to improve the reliability of the electrical interconnect. Large contact force interconnects tend to require increased latch and insertion forces which tend to result in increased costs due to higher force latch springs and larger latching surfaces. Therefore, the electrical interconnect should be capable of providing high reliability and requiring relatively low interconnect forces.

BRIEF SUMMARY OF THE INVENTION

A modular ink delivery system is incorporated in an inkjet printer to facilitate manual replacement of individual ink modules in an ink supply station on the printer frame. A rigid interface component on the printer carries an electrical connector, an ink connection needle, and an air connection needle which are sized and shaped to match an electrical contact, an ink septum and an air septum on the ink module. The interface component is spring loaded in order to rest in either a forward parking position against a backplate or a rearward floating position that allows the interface component to move and rotate some distance in all directions in order to achieve proper alignment position when engaged by the ink module. In an exemplary embodiment wherein four separate ink modules are mounted on the ink supply station, each interface component is capable of independent movement in order to accommodate large tolerances between the ink module and the interface component.

Additional alignment features for achieving satisfactory mounting of the ink supply module in the ink supply station include providing some limited lateral movement of the electrical connector relative to the interface component. In this regard an exemplary embodiment of the invention includes a separate electrical adaptor holding conductive wires and mounted in a lateral slot between flexible arms on the interface component.

Ink leakage is minimized by providing a resilient humidor surrounding the ink connection needle adjacent a needle hole. A biasing spring assures sealing contact between a face of the humidor and the ink septum during ink flow from the ink module through the ink connection needle.

Since operation of the printer is dependent upon satisfactory engagement between each ink module and its respective interface component, the electrical interconnect does not make conductive contact with the electrical contacts until after the ink and air connections have occurred. Thus signal transmission with the ink module provides confirmation of successful installation while non-transmission is indicative of incomplete installation or removal of an ink module.

The present invention is a replaceable ink container for providing ink to an off axis printing system. The printing system responsive to electrical signals from the replaceable ink container for controlling printer parameters. The ink container has a leading edge and a trailing edge relative to a direction of insertion of the ink container into the printing system. The replaceable ink container includes a fluid outlet disposed toward the leading edge. The fluid outlet is configured for fluid connection to a hollow needle associated with the printing system. The hollow needle extends in a direction opposite the insertion direction. Included in the ink container is a plurality of electrical contacts disposed on the ink container. The plurality of electrical contacts are configured for engagement with complementary electrical contacts associated with the printing system. Also included in the ink container is a guide member extending from the ink container along the insertion direction. The guide member is configured for engaging a tapered guide member receiving slot associated with the printing system. This engaging repositions the complementary electrical contacts relative to the hollow needle to ensure proper alignment of complementary electrical contacts with the plurality of electrical contacts during insertion of the ink container into the printing system.

DETAILED DESCRIPTION OF THE PREFERRED EMBODIMENT

Figure 1:
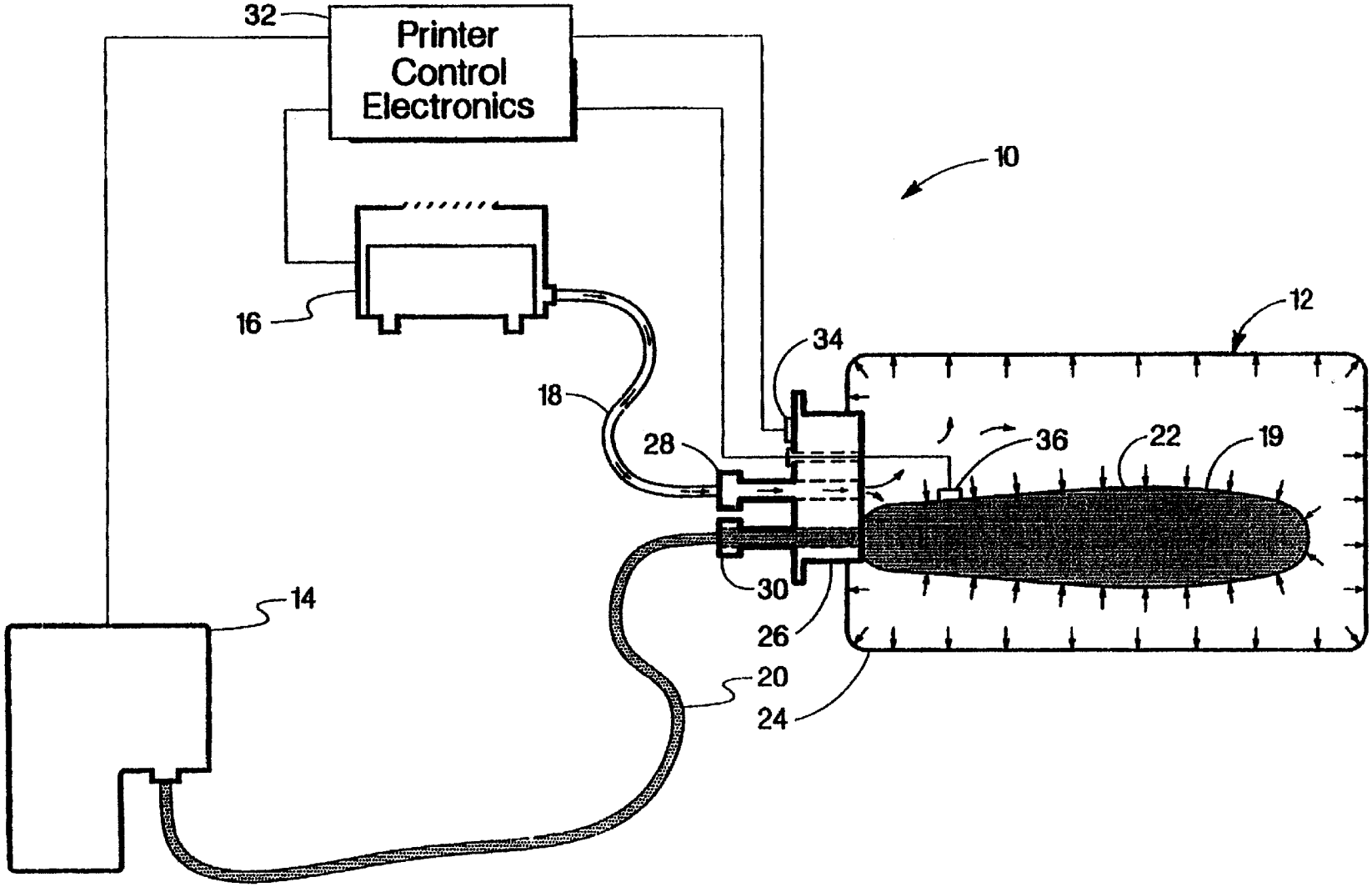
FIG. 1 depicts a schematic representation of a printing system that includes an ink container of the present invention.

FIG. 1 depicts a schematic representation of a printing system 10 which includes the ink container 12 of the present invention. Also included in the printing device 10 is a printhead 14 and a source of pressurized gas such as a pump 16. The pump 16 is connected by a conduit 18 for providing a pressurized gas such as air to the ink container 12. A marking fluid 19 such as ink is provided by the ink container 12 to the printhead 14 by a conduit 20. This marking fluid is ejected from the printhead 14 to accomplish printing.

The ink container 12 which is the subject of the present invention includes a fluid reservoir 22 for containing ink 19, an outer shell 24, and a chassis 26. In the preferred embodiment the chassis 26 includes an air inlet 28 configured for connection to conduit 18 for pressurizing the outer shell 24 with air. A fluid outlet 30 is also included in the chassis 26. The fluid outlet 30 is configured for connection to the conduit 20 for providing a fluid connection between the fluid reservoir 22 and fluid conduit 20.

In the preferred embodiment the fluid reservoir 22 is formed from a flexible material such that pressurization of the outer shell produces a pressurized flow of ink from the fluid reservoir 22 through the conduit 20 to the printhead 14. The use of a pressurized source of ink in the fluid reservoir 22 allows for a relatively high fluid flow rates from the fluid reservoir 22 to the printhead 14. The use of high flow rates or high rates of ink delivery to the printhead make it possible for high throughput printing by the printing system 10.

The ink container 12 also includes a plurality of electrical contacts, as will be discussed in more detail with respect to FIG. 3. The electrical contacts provide electrical connection between the ink container 12 and printer control electronics 32. The printhead control electronics 32 controls various printing system 10 functions such as, but not limited to, printhead 14 activation to dispense ink and activation of pump 16 to pressurize the ink container 12. In one preferred embodiment the ink container 12 includes an information storage device 34 and an ink level sensing device 36. The information storage device 34 provides information to the printer control electronics 32 for controlling printer 10 parameters such as ink container 12 volume as well as ink characteristics, to name a few. The ink level sense device 36 provides information relating to current ink volume in the ink container 12 to the printer control electronics 32.

The present invention is a method and apparatus for forming a reliable electrical interconnect between the ink container 12 and the printer control electronics 32. The technique of the present invention provides alignment of the electrical contacts on each of the ink container 12 and the ink container receiving station as will be discussed in more detail with respect to FIGS. 11A, 11B, 12A and 12B. In addition, the technique of the present invention ensures that a reliable low resistance electrical connection is formed between proper electrical contacts on each of the ink container 12 and the ink container receiving station once the ink container is properly inserted into the ink container receiving station. Before discussing the details of the present invention it will be helpful to fist discuss the overall printing system 10.

Figure 2:
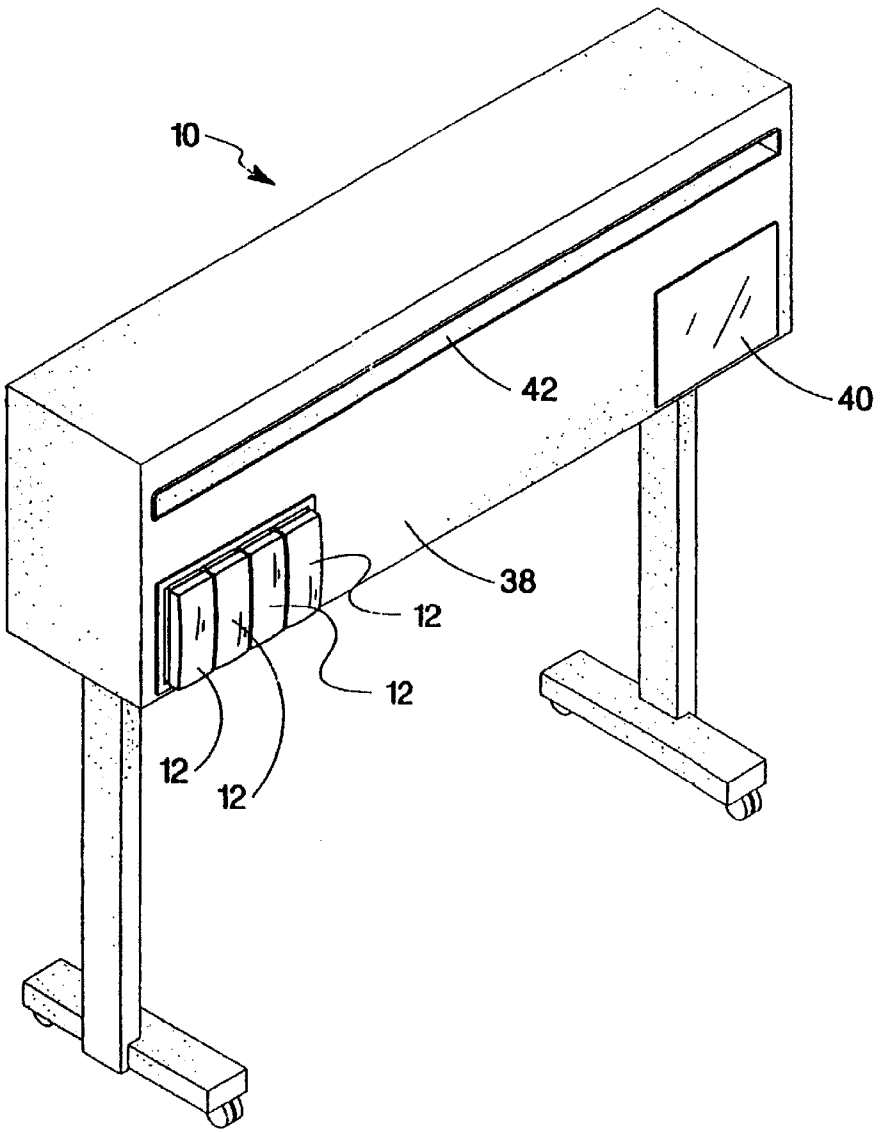
FIG. 2 depicts a perspective view of a representation of the printing system of FIG. 1.

FIG. 2 depicts one embodiment of the printing system 10 shown in perspective. The printing system 10 includes a printing chassis 38 containing one or more ink container 12 of the present invention. The embodiment shown in FIG. 2 is shown having four similar ink containers 12. In this embodiment, each ink container contains a different ink color. Therefore, four color printing is accomplished by providing cyan, yellow, magenta and black ink from the four ink containers 12 to one or more printheads 14. Also included in the printer chassis 38 is a control panel 40 for controlling operation of the printer 10 and a media slot 42 from which print media such as paper is ejected.

As ink 19 in each ink container 12 is exhausted the ink container 12 is replaced with a new ink container 12 containing a new supply of ink. In addition, the ink container 12 may be removed from the printer chassis 38 for reasons other than an out of ink condition such as changing inks for an application requiring different ink properties or for use on different media. It is important that the ink container 12 be not only accessible within the printing system 10 but also easily replaceable. It is also important that the replacement ink container 12 form reliable electrical connection with corresponding electrical contacts associated with the printer chassis 38 as well as properly form necessary interconnects such as fluid interconnect, air interconnect and mechanical interconnect so that the printing system 10 performs reliably. The present invention is directed to a method and apparatus for reliably engaging the ink container 12 into the printer chassis 38 to insure proper electrical interconnection is formed.

It is important that ink spillage and spattering be minimized to provide reliable interconnection between the ink container 12 and printer 10. Ink spillage is objectionable not only for the operator of the printer who must handle the spattered ink container 12 but also from a printer reliability standpoint. Inks used in ink-jet printing frequently contain chemicals such as surfactants which if exposed to printer components can effect the reliability of these printer components. Therefore, ink spillage inside the printer can reduce the reliability of printer components thereby reducing the reliability of the printer.

Figure 3:
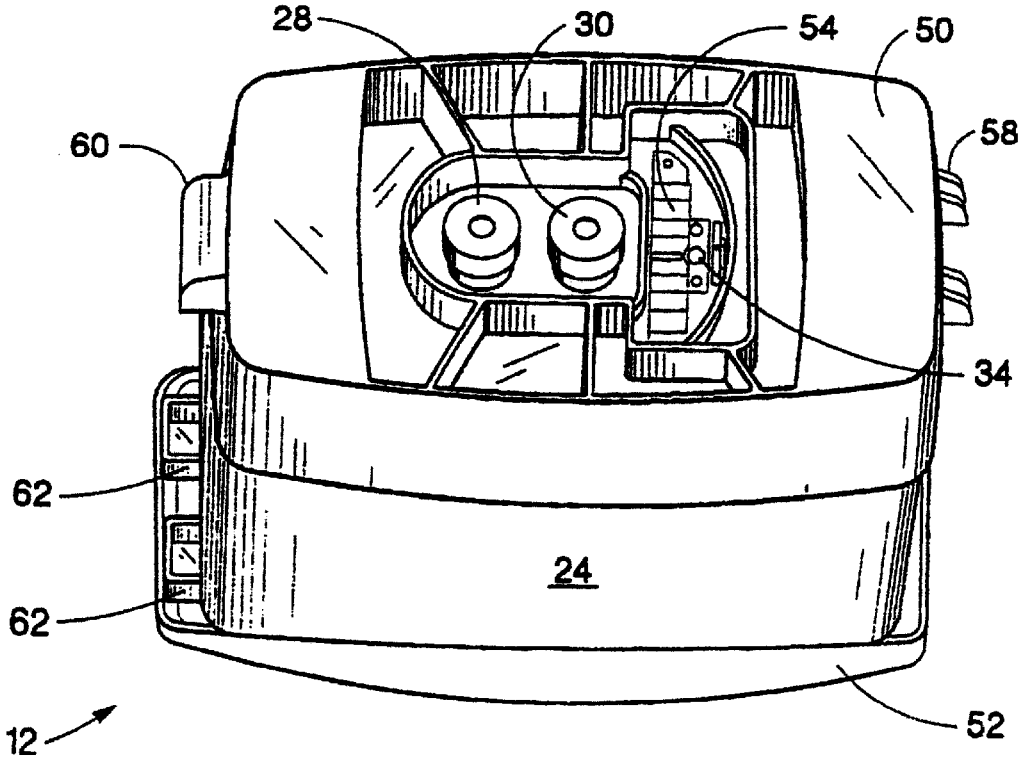
FIG. 3 depicts a perspective view of a leading edge portion of the ink container of the present invention.
Figure 4:
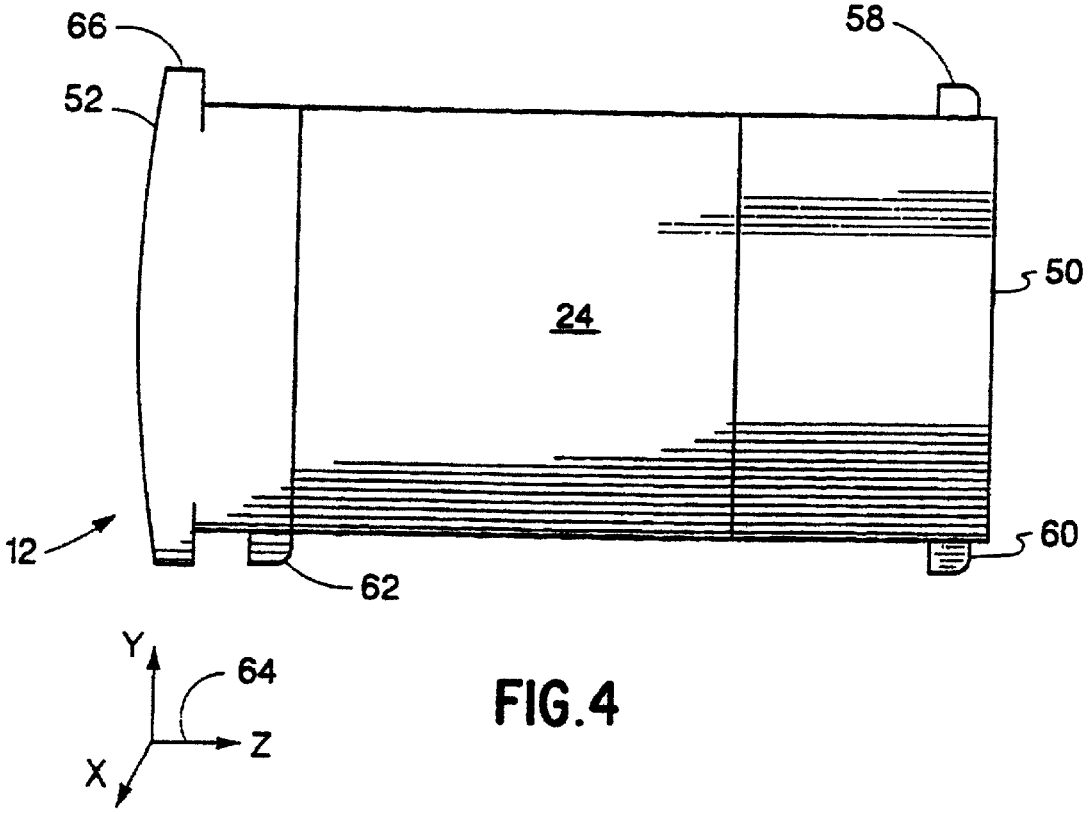
FIG. 4 depicts a side plan view of the ink container of the present invention.

FIGS. 3 and 4 depict the ink container 12 of the present invention. The ink container 12 includes a housing or outer shell 24 which contains the fluid reservoir 22 shown in FIG. 1 for containing ink 19. The outer shell 24 has a leading edge 50 and trailing edge 52 relative to a direction of insertion for the ink container 12 into the printer chassis 38. The leading edge 50 includes the air inlet 28 and the fluid outlet 30 which are configured for connection to the air pump 16 and the printhead 14, respectively, once the ink container 12 is properly inserted into the printer chassis 38. The air inlet 28 and fluid outlet 30 will be discussed in more detail with respect to FIG. 8.

A plurality of electrical contacts 54 are disposed on the leading edge 50 for providing electrical connection between the ink container 12 and printer control electronics 32. In one preferred embodiment the plurality of electrical contacts 54 include a first plurality of electrical interconnects that are electrically interconnected to the information storage device 34 and a second plurality of electrical interconnects which are electrically interconnected to the ink volume sensor 36 shown in FIG. 1. In the preferred embodiment the information storage device 34 is a semiconductor memory and the ink volume sensing device 36 is an inductive sensing device. The electrical contacts 54 will be discussed in more detail with respect to FIG. 5.

The ink container 12 includes one or more keying and guiding features 58 and 60 disposed toward the leading edge 50 of the ink container 12. The keying and guiding features 58 and 60 work in conjunction with corresponding keying and guiding features on the printer chassis 38 to assist in aligning and guiding the ink container 12 during insertion of the ink container 12 into the printer chassis 38. The keying and aligning features 58 and 60 in addition to providing a guiding function also provide a keying function to insure only ink containers 12 having proper ink parameters such as proper color and ink type are inserted into a given slot printer chassis 38. Keying and guiding features are discussed in more detail in co-pending patent application Ser. No. 08/566,521 filed Dec. 4, 1995 entitled "Keying System for Ink Supply Containers" assigned to the assignee of the present invention and incorporated herein by reference.

A latch feature 62 is provided toward the trailing edge 52 of the ink container 12. The latch feature 62 works in conjunction with corresponding latching features on the printer portion to secure the ink container 12 within the printer chassis 38 such that proper interconnects such as pressurized air, fluidic and electrical are accomplished in a reliable manner. The latching feature 62 is a molded tang which extends downwardly relative to a gravitational frame of reference. The ink container 12 shown in FIG. 4 is positioned for insertion into a printer chassis 38 along the Z-axis of coordinate system 64. In this orientation gravitational forces act on the ink container 12 along the Y-axis.

Figure 5:
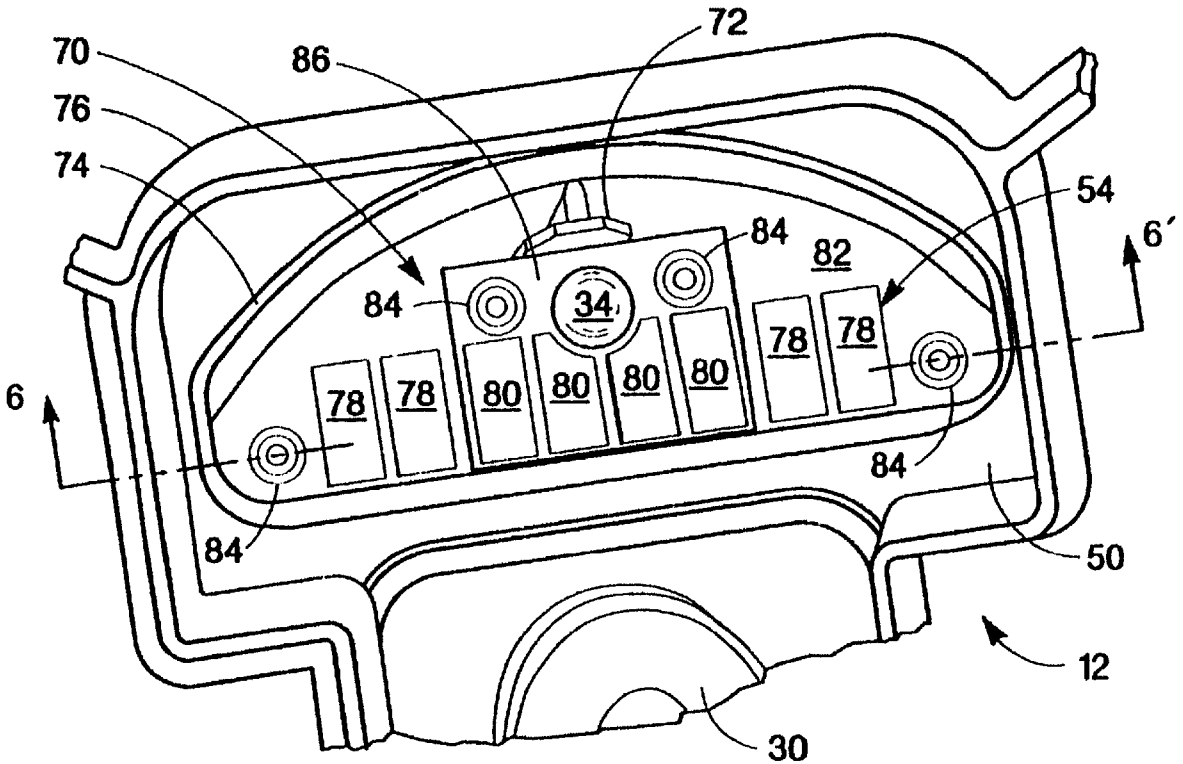
FIG. 5 depicts a top plan view, partially broken away, taken across line 5–5' of the electrical connection portion of the ink container of FIG. 3.

FIG. 5 depicts an electrical interconnect portion 70 which is the subject of the present invention. The electrical interconnect portion 70 includes electrical contacts 54 and upstanding guide member 72, and inner wall member 74, and an outer wall member 76. In the preferred embodiment, the plurality of electrical contacts 54 include electrical contacts 78 which are electrically connected to the fluid sensing device 36 shown in FIG. 1 and electrical contacts 80 which are electrically connected to the information storage device 34. In the preferred embodiment, the electrical contacts 78 are defined in a flexible circuit 82 which is mounted to the ink container 12 by fastener 84. A circuit 86 on which contacts 80 and information storage device 34 are disposed provides electrical connection between the information storage device 34 and contacts 80. The circuit 86 is attached to the ink container 12 by fastener 84.

The inner upstanding wall 74 and the outer upstanding wall 76 help protect the electrical circuit 86, information storage device 34, and contacts 78 and 80 from mechanical damage. In addition, the upstanding walls 74 and 76 help minimize inadvertent finger contact with the electrical contact 78 and 80. Finger contact with the electrical contact 78 and 80 can result in the contamination of these electrical contacts which can result in reliability problems with the electrical connection between the ink container 12 and the printing system 10. Finally, inadvertent contact with the electrical contact 78 and 80 can result in an electrostatic discharge (ESD) which can result in reliability problems with the information storage device 34. If the information storage device is particularly sensitive to electrostatic discharge such a discharge may result in catastrophic failure of the information storage device 34.

Figure 6:
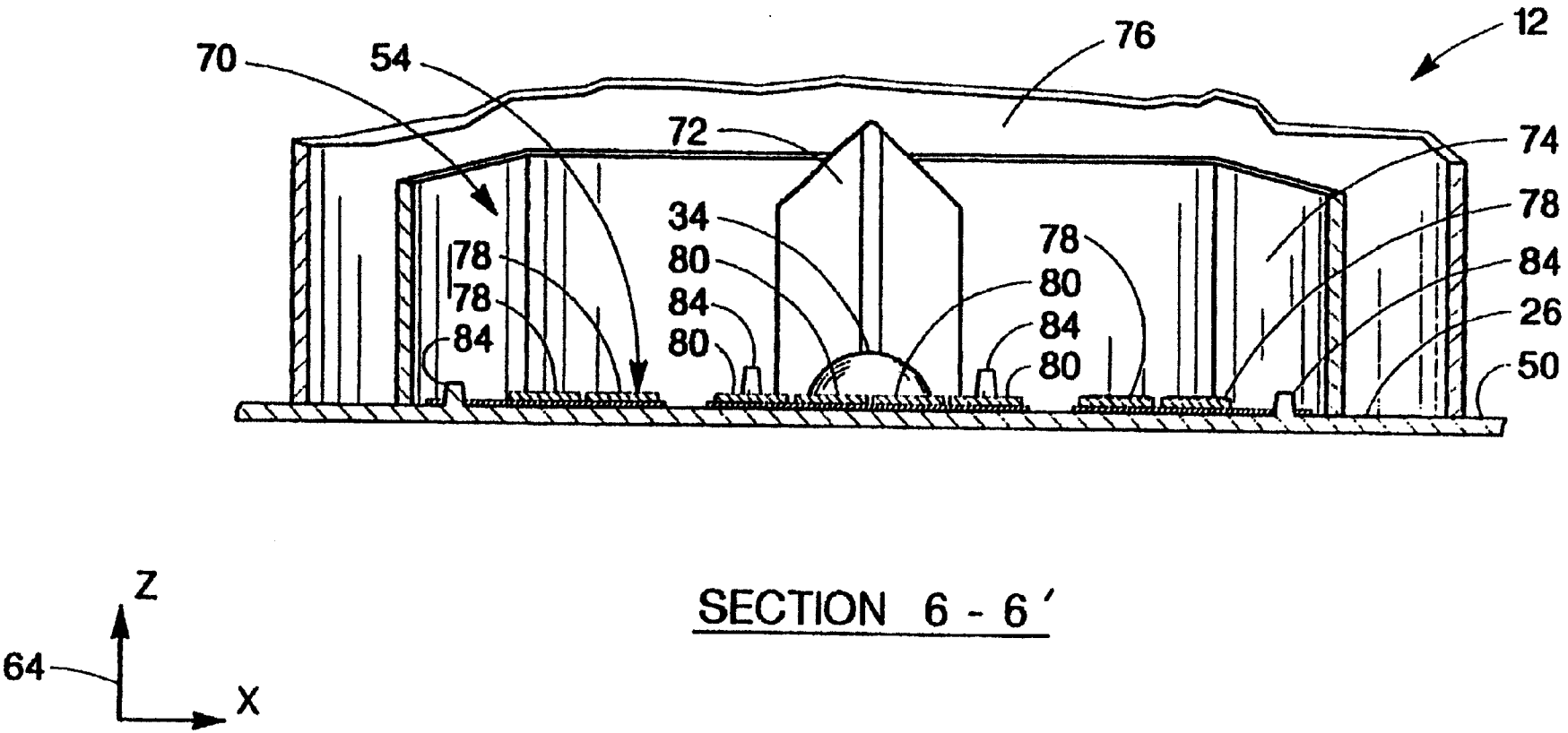
FIG. 6 depicts a side plan view of the electrical connection portion of the ink container taken across lines 6–6' shown in FIG. 5

FIG. 6 shows a sectional view of the electrical interconnect 70 shown in FIG. 5. It can be seen from FIG. 6 that the upstanding member 72 extends outward from a leading edge portion 50 of the ink container 12 along a Z-axis in coordinate system 86. The upstanding guide member 72 in the preferred embodiment is tapered from a leading edge toward the trailing edge. The upstanding guide member as will be discussed with respect to FIGS. 11A, 11*b*, 12*a*, and 12*b* provides a critical guiding function to insure proper electrical connection is accomplished during the insertion of ink container 12 into the printer chassis 38.

In one preferred embodiment the upstanding guide member 72 is formed integrally with an ink container chassis 88. In this preferred embodiment the ink container chassis 88 defines the air inlet 28 as well as the fluid outlet 30.

Figure 7:
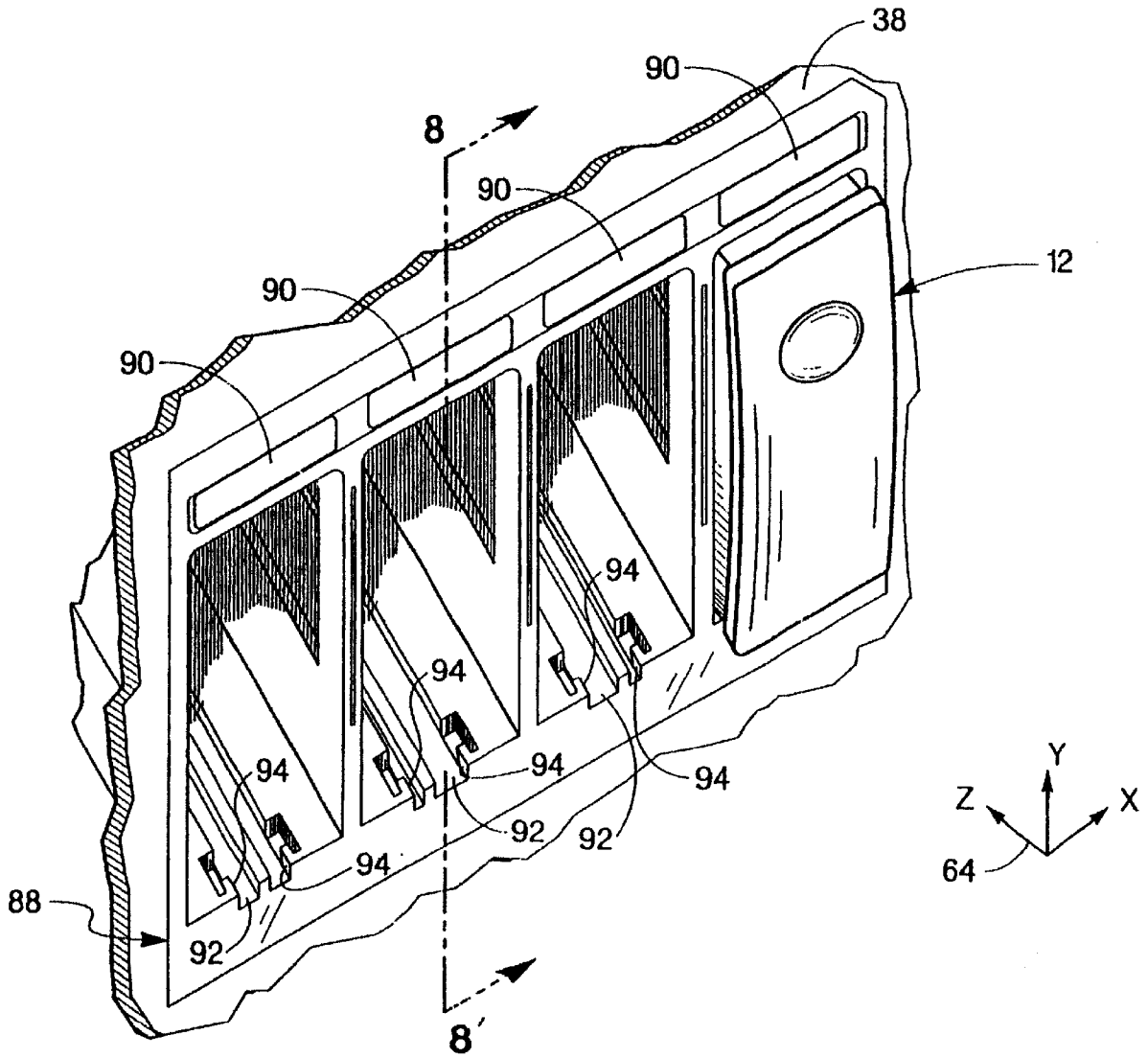
FIG. 7 depicts a perspective view of an ink container receiving station shown partially broken away with an ink container of the present invention installed.

FIG. 7 depicts an ink container 12 of the present of the present invention shown secured within an ink container receiving station 88 within the printer chassis 38. Because ink container 12 is similar except for keying and guiding features 58 and 60 and corresponding ink properties contained within the respected fluid reservoir, the same reference numbering will be used for each ink container 12. An ink container indicia 90 may be positioned proximate each slot in the ink container receiving station 88. The ink container indicia 90 may be a color swatch or text indicating ink color to assist the user in color matching for inserting the ink container 12 in the proper slot within the ink container receiving station 88. As discussed previously the keying and guiding features 58 and 60 shown in FIGS. 3 and 4 prevent ink containers from being installed in the wrong slot. Installation of an ink container in the wrong slot can result in improper color mixing or the mixing of inks of different ink types each of which can result in poor print quality.

Each receiving slot within the ink container receiving station includes a corresponding keying and guiding slot 92 and a recessed latching portion 94. The guiding slot 92 cooperates with the keying and guiding features 58 and 60 to guide the ink container 12 into the ink container receiving station 88. The keying and guiding slot 92 associated with the corresponding keying and guiding feature 60 is shown in FIG. 5 and the keying and guiding slot associated with the corresponding keying and guiding feature 58 on the ink container 12 is not shown. The latching features 94 are configured for engaging the corresponding latching features 62 on the ink container 12.

Figure 8:
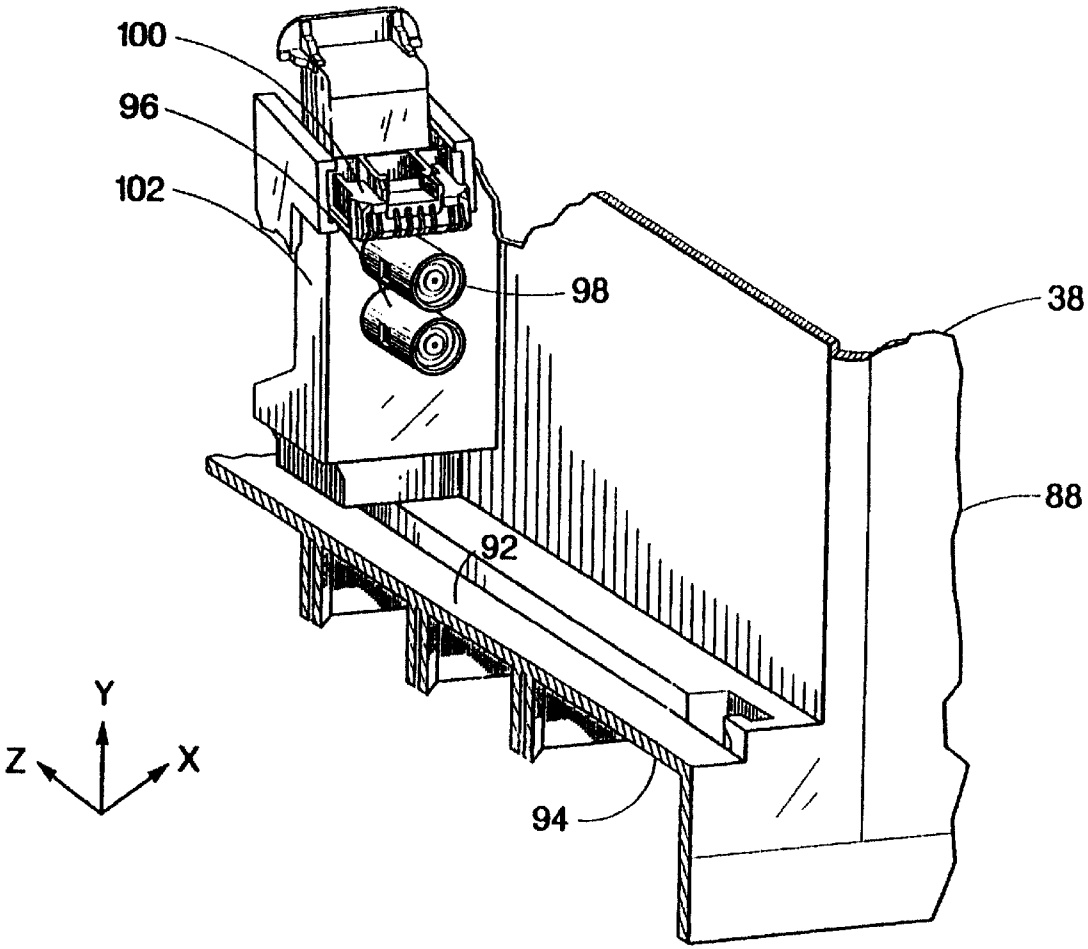
FIG. 8 depicts a cross-section taken across line 8–8' of the ink container receiving station of FIG. 7 shown partially broken away.
Figure 9:
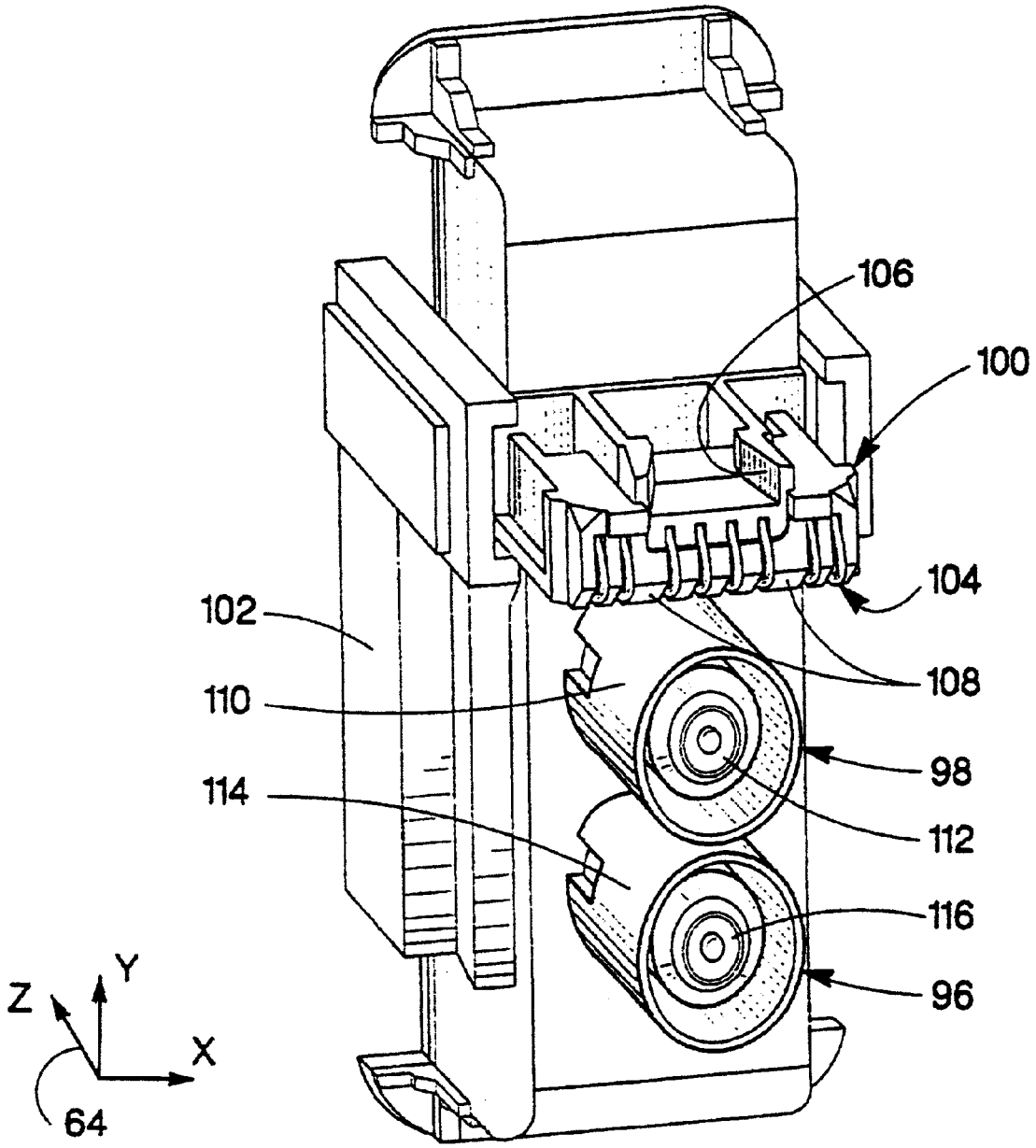
FIG. 9 depicts electrical, fluid and air connectors shown greatly enlarged of the ink container receiving station shown FIG. 8.

FIG. 8 shows a cross-section of a single ink container receiving slot within the ink container receiving station 88. The ink container receiving slot includes interconnect portions for interconnecting with the ink container 12. In the preferred embodiment these interconnect portions include a fluid inlet 98, and air outlet 96 and an electrical interconnect portion 100. Each of the interconnects 96, 98, and 100 are positioned on a floating interconnect portion 102 which is biased along the Z-axis toward the installed ink container 12 by compression springs 208, 210 (see FIGS. 12A and 13A) thereby providing independent coupling with each manually replaceable ink container module.

The fluid inlet 98 and the air outlet 96 associated with the ink container receiving station 88 are configured for connection with the corresponding fluid outlet 30 and air inlet 28, respectively on the ink container 12. The electrical interconnect 100 is configured for engaging the plurality of electrical contact 54 on the ink container 12.

It is the interaction between the keying and guiding features 58 and 60 associated with the ink container 12 and the corresponding keying and guiding feature 92 associated with the ink container receiving station 88 which guide the ink container 12 during the insertion such that proper interconnection are accomplished between the ink container 12 and the printer chassis 38. In addition, sidewalls associated with each slot in the ink container receiving station 88 engage corresponding sidewalls of the outer shell 24 of ink container 12 to assist in guiding and aligning the ink container 12 during insertion into the ink container receiving station 88.

FIGS. 9, 11, 12A and 13A illustrates further detail of the floating interconnect portion 102 shown in FIG. 8. The floating interconnect portion 102 is spring biased by compression springs 208, 210 in order for each interface component to be capable of independent movement in all directions when engaged by an ink container module in a direction opposite the direction of insertion of the ink container 12 into the ink container receiving station 88. The floating interconnect portion 102 is biased towards a backplate 103 to provide mechanical restraints which limit the motion of the floating interconnect portion in each of the X, Y, and Z-axis. Therefore, the floating interconnect portion 102 has a limited degree of motion in each of the X, Y, and Z axis of coordinate system 86.

For additional disclosure of the aforesaid mechanical constraints and resilient mounting of each floating interconnection portion 102 by compression springs 208, 210 to provide such longitudinal, lateral and/or rotary movement for each ink module during installation, see FIG. 15 in U.S. Ser. No. 09,240,039 entitled REPLACEABLE INK DELIVERY TUBE SYSTEM FOR LARGE FORMAT PRINTER as previously incorporated herein by reference.

It will be understood from the foregoing description and drawings the present invention provides a method of replenishment for an inkjet printer having a printhead cartridge mounted on a carriage, with a supply tube connected between the printhead cartridge and an auxiliary supply station. The auxiliary supply station includes a storage module with a supply bag having an outlet, and also having a memory element with a signal contact. The supply bag is filled with a given type of application fluid. An interface component is provided with a fluid connector and a signal connector, and the interface component is movable between a parking position and a floating position. The storage module is installed on the printer by making conductive contact between the signal connector and the signal contact and also by coupling the outlet with the fluid connector to allow the application fluid to flow from the supply bag to the printer cartridge while the interface component is in the floating position.

The electrical interconnect portion 100 which is the subject of the present invention is mounted such that the electrical interconnect 100 is free to move in a direction generally orthogonal to the direction of insertion or along the X-axis relative to the floating interconnect portion 102. The electrical interconnect portion 100 is mounted such that mechanical restraints limit the amount of motion of the electrical interconnect 100 along the X-axis.

The electrical interconnect portion 100 includes a plurality of spring biased electrical contacts 104. The electrical contacts 104 engage corresponding electrical contacts 54 associated with the ink container 12 to electrically connect the ink container 12 with the printer control electronics 32 shown in FIG. 1.

The electrical connector 100 further includes a guide slot 106 and a pair of guide members 108. The guide slot together with the pair of guide members 108 cooperate to engage the upstanding guide member 72 and inner wall 74 to properly align the electrical interconnect 100 with the electrical interconnect 70 associated with the ink container 12. Proper alignment of the electrical interconnect 100 associated with the ink container receiving station 88 with the electrical interconnect 70 associated with the ink container involves the proper alignment of the spring biased electrical contacts 104 with corresponding electrical contacts 54 associated with the ink container 12. The electrical interconnect 100 will be discusses in more detail in respect to FIG. 10.

The floating interconnect portion 102 also includes a fluid inlet 98 and air outlet 96. In the preferred embodiment the fluid inlet 98 includes a housing 110 having an upstanding ink connector needle and a resilient humidor having a spring biased sealing portion 112 surrounding the ink connector needle therein. Similarly, the air outlet 96 includes an upstanding member 114 having an upstanding air connector needle and may include a spring biased sealing portion 116 disposed therein. With the ink container 12 properly inserted into the ink container receiving station 88 fluid outlet 30 and air inlet 28 are inserted into the housing 110 and housing 114, respectively such that the aforesaid needles and sealing members 112 and 116, respectively form the proper respective fluid and air interconnects with the ink container 12.

Figure 10:
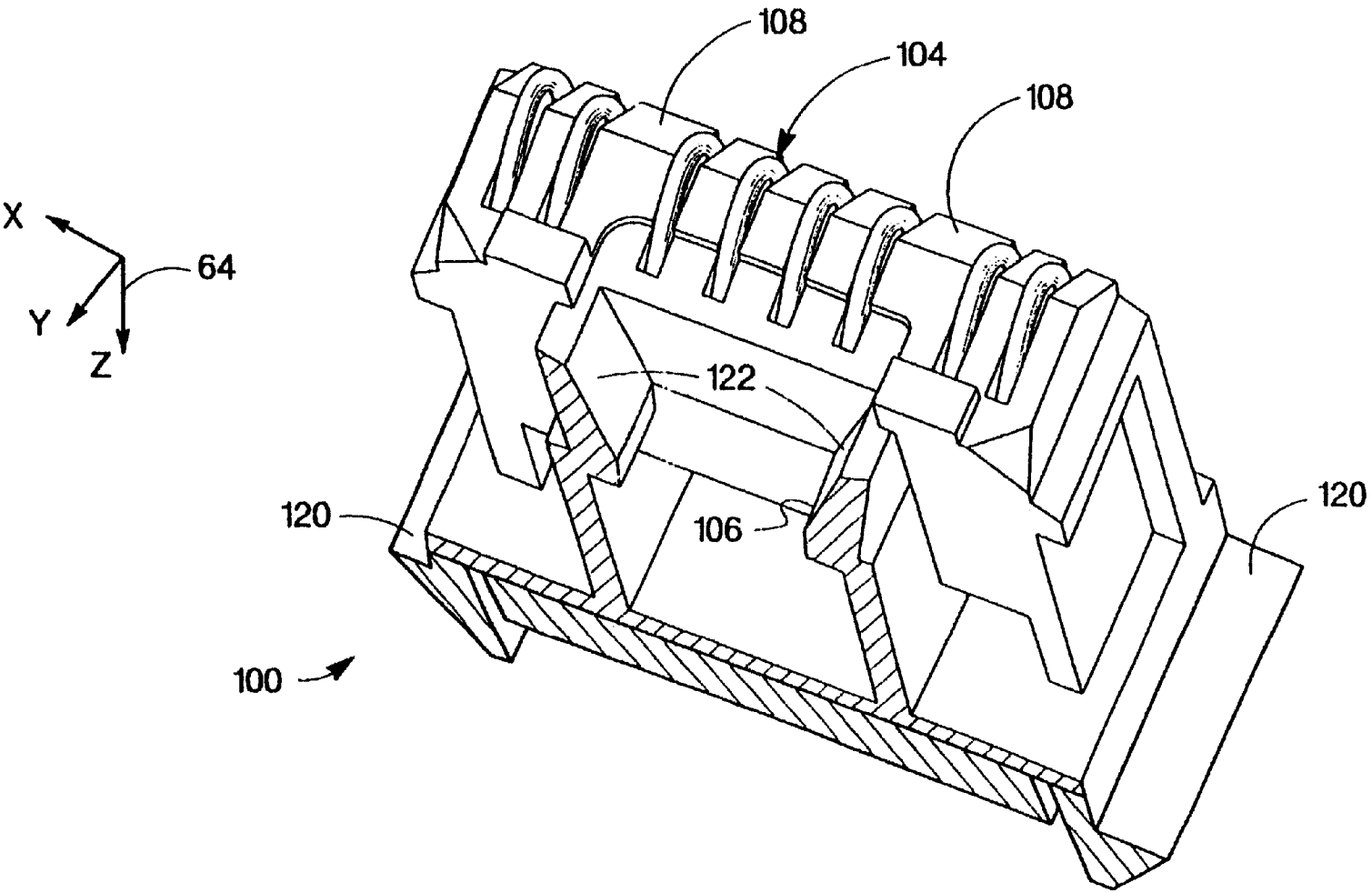
FIG. 10 depicts a perspective view of the electrical connector of FIG. 9 shown greatly enlarged.

FIG. 10 discloses the electrical interconnect 100 of the present invention. The electrical interconnect 100 includes shoulder portions 120 which fit into corresponding slot (not shown) on the floating interconnect portion 102 allowing the electrical interconnect 100 to move freely along the X-axis within a limited range of motion. The guiding slot 106 includes tapered portions 122 which allow the guiding slot 106 to receive the upstanding member 72 associated with the electrical interconnect 70 on ink container 12. It is the upstanding guide member 72 which provides proper alignment along the X-axis for the interconnect 100 such that the spring biased electrical contacts 104 properly engage the corresponding electrical contacts 54 associated with the ink container 12.

Figure 11:
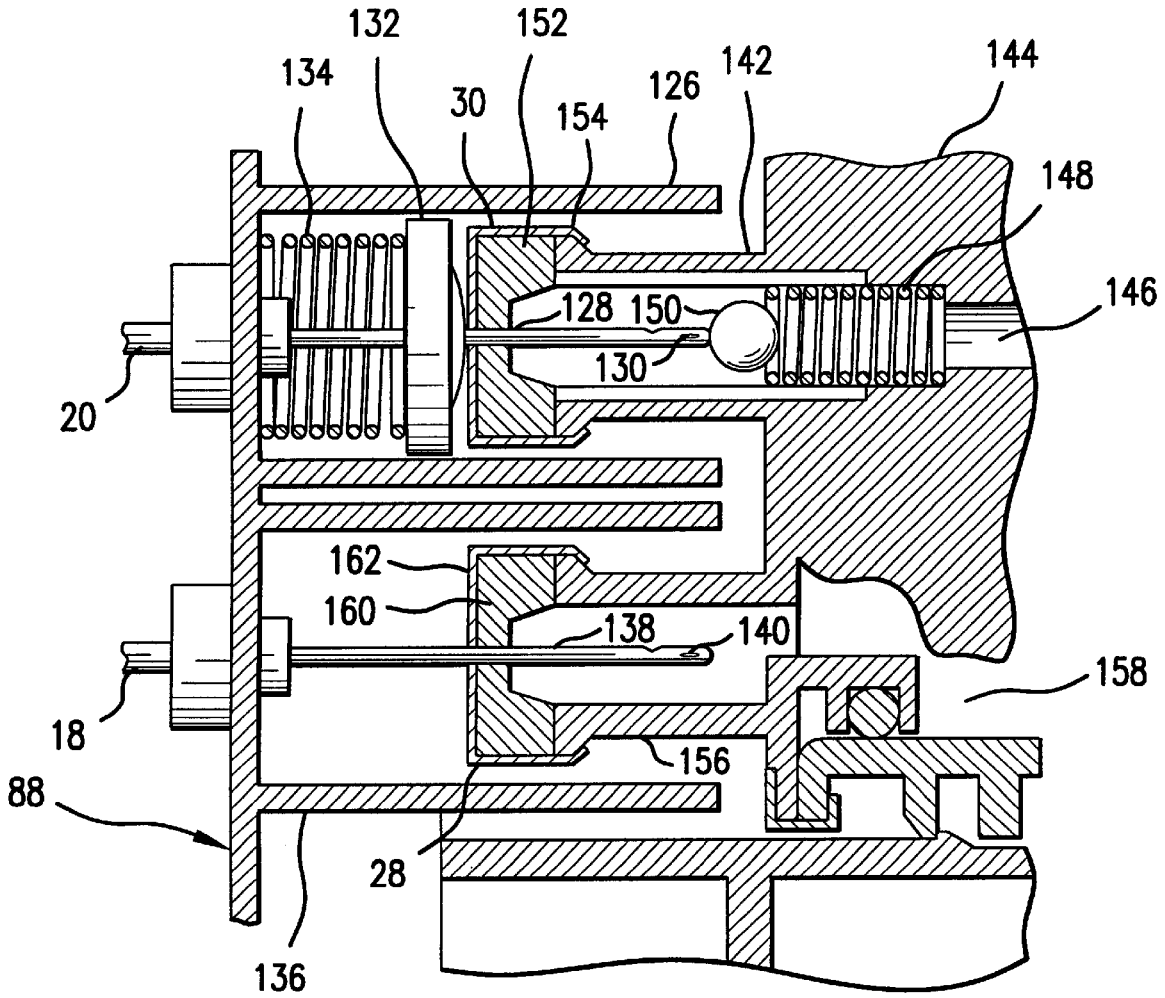
FIG. 11 depicts a cross section of a fluid outlet and an air inlet for the ink container of the present invention shown in engagement with a fluid inlet and air outlet, respectively, associated with the ink container receiving station shown in FIG. 8.

FIG. 11 illustrates further detail of the preferred the fluid outlet 30 and air inlet 28 associated with the ink container 12 and the corresponding fluid inlet 98 and air outlet 96 associated with the ink container receiving station 88.

In this preferred embodiment the fluid inlet 98 associated with the ink container receiving station 88 includes a housing 126 and outwardly extending needle 128 having a closed, blunt upper end, a blind bore (not shown) and a lateral hole 130. The blind bore is fluidly connected to the lateral hole 130. The end of the needle 128 opposite the lateral hole 130 is connected to the fluid conduit 20 for providing ink to the printhead 14 shown in FIG. 1. The resilient humidor is shown as a sliding collar 132 which surrounds the needle 128 and is biased upwardly by spring 134 to assure sealing contact between a face of the humidor and a compliant septum during ink flow from the ink module through the ink connection needle 128. The sliding collar 132 has a compliant sealing portion 112 with an exposed upper surface and an inner surface in direct contact with the needle 128 thereby surrounding the ink connection needle 128 adjacent the lateral hole 130 in order to minimize ink leakage.

The air outlet 96 on the ink container receiving station 88 is similar to the fluid inlet 98 except does not require the sliding collar 132 and the spring 134. The air outlet 96 on the ink container receiving station 88 includes a housing 136 and an outwardly extending needle 138 having a closed, blunt upper end, a blind bore (not shown) and a lateral hole 140. The blind bore is fluidly connected to the lateral hole 140. The end of the needle 138 opposite the lateral hole 140 is connected to the air conduit 18 for providing pressurized air to the ink container 12 shown in FIG. 1.

In this preferred embodiment, the fluid outlet 30 associated with the ink container 12 includes a hollow cylindrical boss 142 that extends outward from an ink container chassis 144. The end of the boss 142 toward the chassis 144 opens into a conduit 146 which is fluidly connected to the ink reservoir 22 thereby providing fluid to the fluid outlet 30. A spring 148 and sealing ball 150 are positioned within the boss 142 and held in place by a compliant septum 152 and a crimp cover 154. The spring 148 biases the sealing ball 150 against the septum 152 to form a fluid seal.

In the preferred embodiment, the air inlet 28 associated with the ink container 12 is similar to the fluid outlet 30 except that the additional seal formed by the spring 148 and sealing ball 150 are eliminated. The air inlet 28 associated with the ink container 12 includes a hollow cylindrical boss 156 that extends outward from an ink container chassis 144. The end of the boss 156 toward the chassis 144 opens into a conduit 158 which is in communication with a region between the outer shell 24 and an outer portion of the fluid reservoir 22 for pressurizing the fluid reservoir 22. A compliant septum 160 and a crimp cover 162 form a seal.

The insertion of the ink container 12 into the ink container receiving station 88 such that proper interconnection is formed will now be discussed with respect to FIGS. 12*a*, 12*b*, 13*a*, and 13*b*. As the ink container 12 is initially inserted into the ink container receiving station 88 the keying and guiding features 58 and 60 associated with the ink container must be properly aligned with corresponding keying and guiding features 92 associated with the ink container receiving station 88. Proper alignment of these keying and guiding features ensures that the ink container 12 is inserted in the proper slot within the ink container receiving station 88.

Figure 12B:
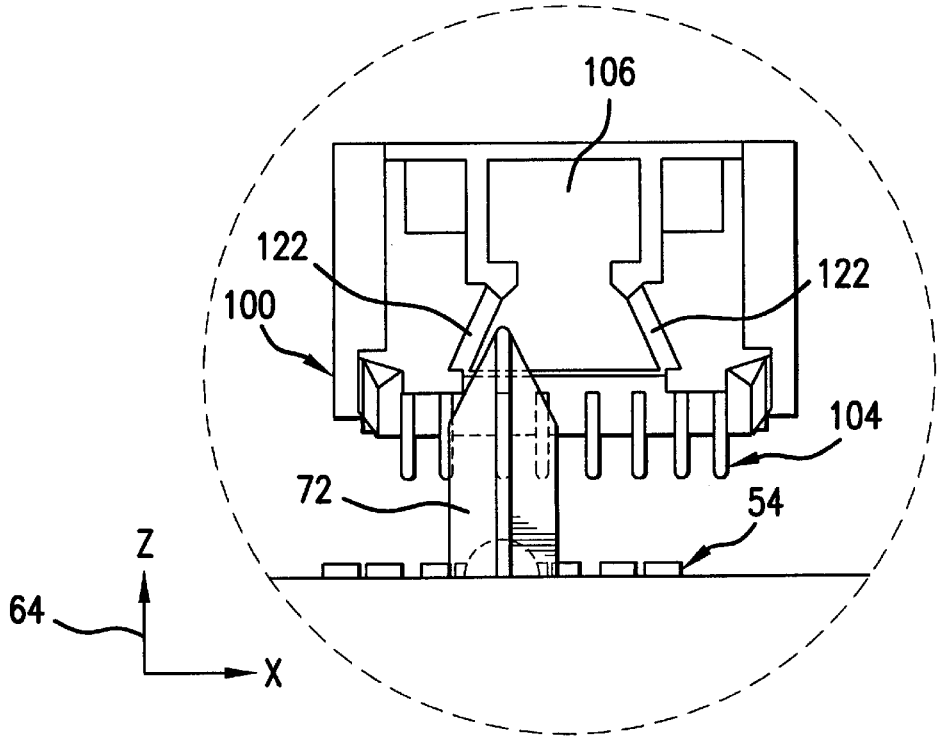
FIGS. 12A and 12B depict a side and top plan views, respectively, shown partially broken away, illustrating partial alignment of the electrical connectors with the ink container of the present invention partially inserted.
Figure 12A:
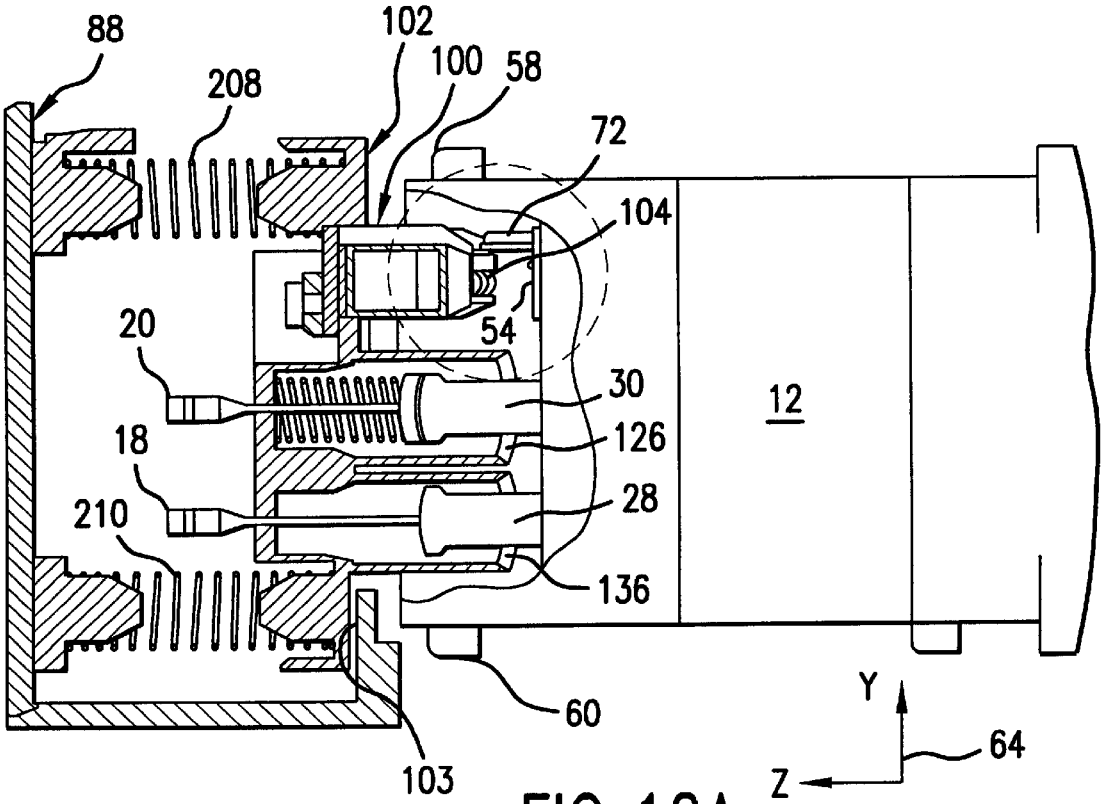

As shown in FIGS. 12A and 12B, further insertion of the ink container 12 into the ink container receiving station 88 results in the outwardly extending fluid outlet 30 and air inlet 28 engaging the corresponding housing associated with the fluid inlet and air outlet 126 and 136, respectively on the ink container receiving station 88. As the fluid and air interconnects 30 and 28 engage the housing members 126 and 136, respectively the floating interconnect 102 is aligned along the X and Y axis with the ink container 12. In the preferred embodiment, the electrical interconnect 70 fluid outlet 30, and air inlet 28 are all formed integrally on the same chassis portion of ink container 12. Therefore, alignment of the floating interconnect portion 102 with the fluid outlet 30 and air inlet 28 provides a coarse alignment of the electrical interconnect 100 associated with the ink container receiving station 88 with the electrical interconnect 70 associated with the ink container 12.

It can be seen from FIG. 12B the electrical contacts 54 associated with the ink container are not in proper alignment with the electrical spring contacts 104 associated with the ink container receiving station. However, the coarse alignment along the X and Y-axis provided by the fluid and air interconnects 30 and 28 with the corresponding fluid and air housing members 126 and 136, respectively ensures that the guide member 72 is at least roughly aligned with the guide slot 106. As the ink container 12 is further inserted into the ink container receiving station 88 the tapered portion on each of the upstanding guide member 72 and tapered portions 122 on the guide slot 106 exert a force on the electrical interconnect 100 to urge the electrical interconnect along the X-axis relative to the interconnect portion 102 to provide a centering of the upstanding guide member 72 within the receiving slot 106.

Figure 13B:
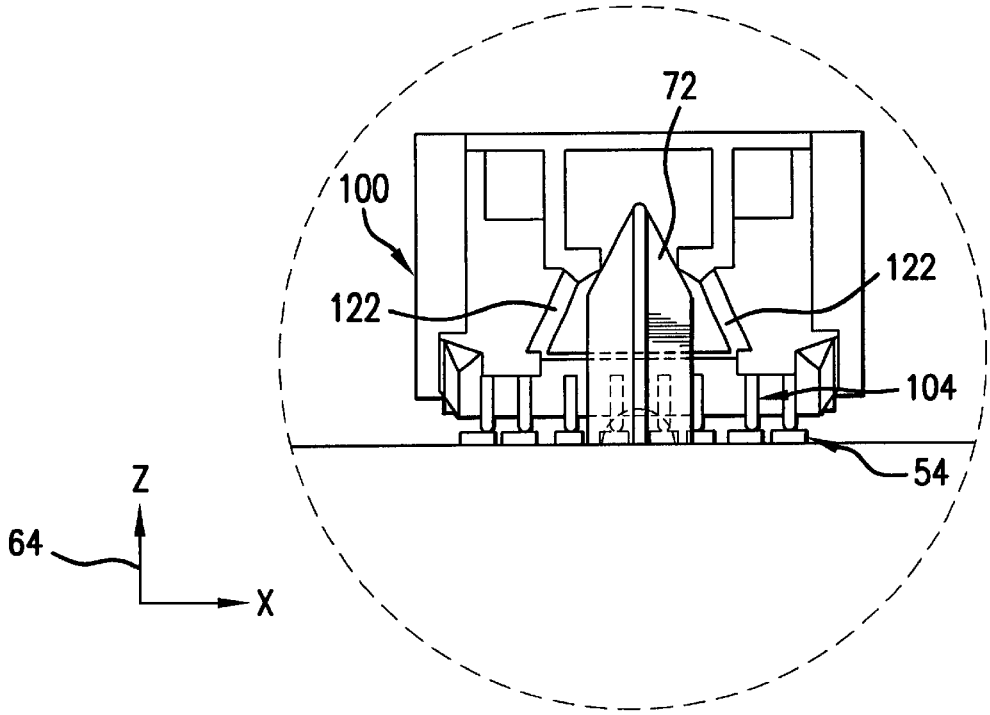
FIGS. 13A and 13B depict a side and top plan views, respectively, shown partially broken away, illustrating complete alignment of the electrical connectors with the ink container of the present invention fully inserted.
Figure 13A:
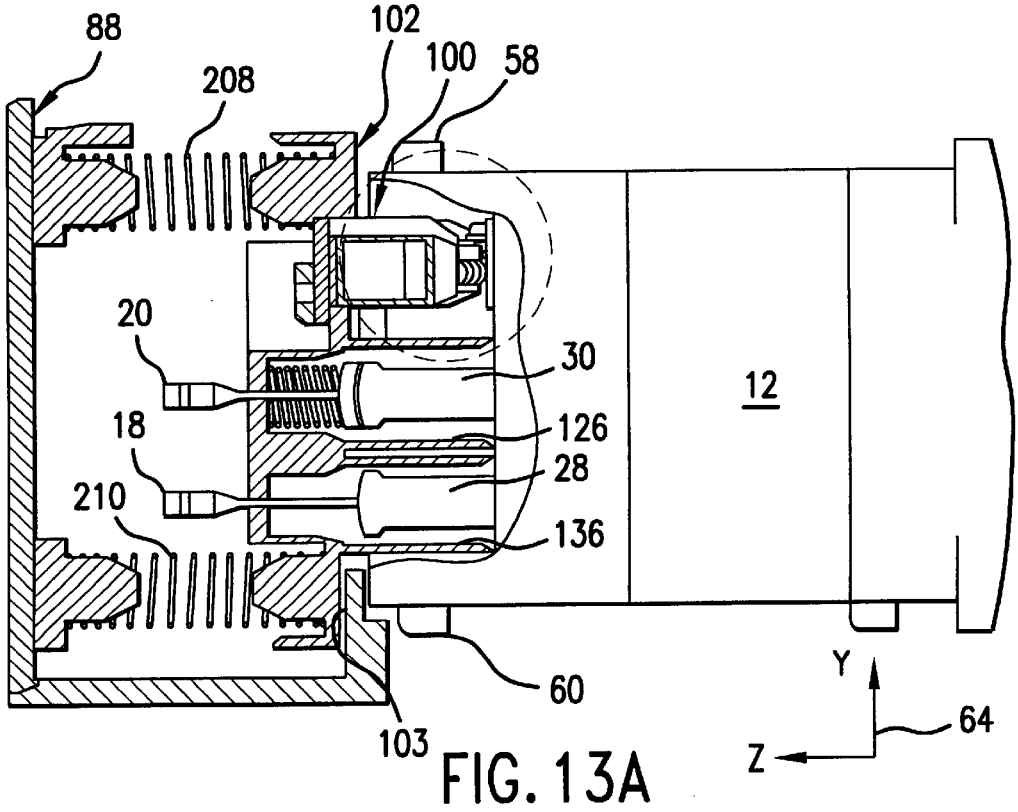

FIG. 13A shows the ink container 12 fully inserted into the ink container receiving station 88. In this fully inserted position proper fluid and air interconnects are formed between the ink container 12 and the ink container receiving station 88. In addition, as shown in FIG. 13B the electrical interconnect 100 is urged into a centered position by the engagement of the upstanding guide member 72 and guide slot 106. In this centered position the electrical contacts 54 associated with the ink container 12 engage the proper spring biased electrical contacts 104 associated with the ink container receiving station 88. Because the spring biased electrical contacts 104 are biased against the electrical contacts 54 a proper low resistance electrical contact is formed.

The present invention makes use of an electrical interconnect system which allows for misalignment between both the ink container 12 and receiving station 88. Because the present invention makes use of both a initial coarse alignment system for aligning the fluid and air interconnects and a subsequent separate fine alignment system for aligning the electrical interconnects a large amount of misalignment between the ink container 12 and the receiving station can be tolerated. In accordance with the foregoing description and as shown in the drawings, it is understood that the ink container contacts 54 do not make conductive contact with the electrical interconnect contacts 104 on floating interconnect portion 102 until after the ink and air connections have occurred. As a result, signal transmission with the ink module container 12 provides confirmation of successful installation while non-transmission indicates incomplete installation or removal of the ink module container.

An important feature which allows for this misalignment between the ink container and printer portion is the use of an electrical interconnect on the printer portion that is movable relative to the fluid and air interconnects. The electrical interconnect makes use of an alignment member for aligning the electrical interconnect separately from the fluid and air interconnects. By using an alignment member associated with each of the electrical interconnects which is a separate from the fluid interconnects proper electrical alignment is ensured. The alignment system of the present invention makes it possible to use ink containers 12 which are formed using inexpensive molding processes to be used while ensuring an accurate and highly reliable electrical interconnect as well as fluid interconnects are formed.

Various changes and improvements can be made to the illustrated embodiments disclosed herein without departing from the sprit and scope of the invention as set forth in the following claims.

We claims as our invention:

1. A system for removably installing an ink supply container in an inkjet printer comprising:

a frame for holding one or more ink supply containers;

an ink outlet port and an air supply port on each of the supply containers;

an interconnect member mounted on said frame and having an ink supply interface and an air supply interface; and a flexible mounting device attached between said frame and said interconnect member and biased to engage a portion of the ink supply container during installation of the supply container on the frame in order to move said interconnect member relative to said frame to facilitate lateral alignment of the ink supply container on said frame such that said ink outlet port is operatively coupled to said ink supply interface and said air supply port is operatively coupled to sad air supply interface.

2. The system of claim 1 which further includes a needle and a septum junction to couple said ink outlet port with said ink supply interface, with a spring loaded compliant humidor surrounding said needle and engageable with said septum to deter ink leakage.

3. The system of claim 1 which further includes a biasing spring for flexibly connecting said interconnect member to said frame to allow relative movement of the interconnect member laterally, longitudinally and/or in a rotary direction during installation of the ink supply container.

4. The system of claim 3 wherein said biasing spring holds said ink outlet port operatively coupled to said ink supply interface and said air supply port operatively coupled to said air supply interface after installation.

5. A system for installing an ink supply container in an inkjet printer comprising:

a frame for holding one or more ink supply containers;

an interconnect member mounted on said frame and having an ink supply interface and an air supply interface; and a flexible mounting device attached between said frame and said interconnect member and biased to engage a portion of the ink supply container while allowing said interconnect member to move relative to facilitate mounting the ink supply container on said frame, wherein said flexible mounting device allows said interconnect member to have rotary movement relative to said frame.

6. The system of claim 5 wherein said flexible mounting device allows said interconnect member to move laterally relative to said frame.

7. The system of claim 5 wherein said flexible mounting device allows said interconnect member to move longitudinally relative to said frame.

8. The system of claim 5 wherein said flexible mounting device allosw said interconnect member to have longitudinal movement relative to said frame.

9. A method of mounting a plurality of ink supply containers on a printer having multiple printheads, comprising:

providing an air pressure interface and an ink passage interface on a printer frame;

locating the air pressure interface and the ink passage interface on a separate connector associated with each ink supply container, respectively, with each ink passage interface connected through a tube member to one of the multiple printheads; and flexibly positioning the connector relative to the printer frame by mounting each connector on a biasing spring in order to allow independent relative movement of each connector during installation of the plurality of ink supply containers and wherein the biasing spring holds the air pressure interface operatively coupled to an air portal on the ink supply container and holds the ink passage interface operatively coupled to an ink outlet on the ink supply container after the aforesaid installation.

10. The method of claim 9 including flexibly positioning each connector relative to the printer frame during removal of each ink supply container.

11. A method of providing resplenishment for an inkjet printer having a printhead cartridge mounted on a carriage, with a supply tube connected between the printhead cartridge and an auxilliary supply station, comprising:

providing an storage module with a supply bag having an outlet, and also having a memory element with a signal contact;

filling the supply bag with a given type of application fluid;

providing an interface component with an fluid connector and a signal connector, the interface component being movable between a parking position and a floating position;

installing the storage module on the printer by making conductive contact between the signal connector and the signal contact and also by coupling the outlet with the fluid connector to allow the application fluid to flow from the supply bag to the printhead cartridge while the interface component is in the floating position.

12. The method of claim 11 which further includes providing a casing member on the storage module for holding the supply bag, with an air portal on the casing; and further includes providing an air connector on the interface component; and wherein said installing includes installing the storage module on the printer by coupling the air portal with the air connector to create a certain amount of air pressure acting upon the supply bag.

13. The method of claim 12 which includes placing the interface component in the floating position during said installing of the storage module on the printer in order to facilitate alignment of the air portal with the air connector.

14. The method of claim 12 wherein said coupling of the air portal with the air connector occurs prior to said making conductive contact between the signal connector and the signal contact.

15. The method of claim 11 which includes placing the interface component in the parking position when the storage module is separated from the interconnect component.

16. The method of claim 11 which includes placing the interface component in the floating position during said installing of the storage module on the printer in order to facilitate alignment of the outlet with the fluid connector.

17. The method of claim 11 wherein said coupling of the outlet with the fluid connector occurs prior to said making conductive contact between the signal connector and the signal contact.

* * * * *